US005213234A

United States Patent [19]

Stefanopoulos

[11] Patent Number: 5,213,234

[45] Date of Patent: May 25, 1993

[54] MOO CREAM PITCHER

[76] Inventor: Ioannis Stefanopoulos, 4720 N. 23 St., Arlington, Va. 22207

[21] Appl. No.: 796,015

[22] Filed: Nov. 22, 1991

[51] Int. Cl.[5] ..... B67D 5/00

[52] U.S. Cl. ..... 222/78; 222/39; 369/63

[58] Field of Search ..... 222/39, 78, 465.1, 41; 239/72, 211; 446/74, 247, 397, 404, 475, 483; D7/301, 302; 369/63, 68

[56] References Cited

U.S. PATENT DOCUMENTS

| | | | |
|---|---|---|---|
| 2,577,849 | 12/1951 | Henry | 222/78 |
| 3,230,661 | 1/1966 | Gleason | 222/78 X |
| 4,185,412 | 1/1980 | Goldfarb et al. | 222/78 X |
| 4,765,465 | 8/1988 | Yamada et al. | 369/63 |
| 4,978,030 | 12/1990 | Morris et al. | 222/78 X |
| 5,071,387 | 12/1991 | Pottick | 222/78 X |
| 5,083,965 | 1/1992 | Mayem | 446/297 |

FOREIGN PATENT DOCUMENTS

| | | | |
|---|---|---|---|
| 1260873 | 9/1989 | Canada | 222/39 |

*Primary Examiner*—Andres Kashnikow
*Assistant Examiner*—Philippe Derghshani

[57] ABSTRACT

A ceramic or plastic pitcher, in the form of a cow, with a hollow body for the purpose of filling with milk or other liquids with a hollow chamber at the rear end of the body for the purpose of housing a gravity activated electronic switch, whereas the switch will produce the sound of an animal when the pitcher will be lifted and tilted to pour the liquid through the mouth of the animal.

4 Claims, 1 Drawing Sheet

MOO CREAM PITCHER

BACKGROUND OF INVENTION

This invention relates to utility devices and in particular to a cream pitcher with an electronic chip, "mooing" device.

Presently all porcelain pitchers available are made just to pour cream from their mouths without any sort of sound effects.

My invention, a porcelain, ceramic, or plastic pitcher will now "moo" as it pours the cream or milk.

SUMMARY OF THE INVENTION

The intention of this invention is to provide a new and improved type of cream pitcher that, because of its design, will hold more liquid, will pour without spilling when it's tilted, and, most importantly, when tilted, will "moo" while it is pouring. By doing so, the cow becomes more realistic and amuses the people who hear it.

Hence, the purpose of The Moo Cream Pitcher is dual: it is useful and amusing. Useful because any household can use it to pour cream from, and amusing because of the laughter it creates when people hear the unexpected realistic "mooing" sound effects, as the tests proved.

The accompanying drawings, in conjunction with the following description, illustrate in detail the scope of the invention.

DETAILED DESCRIPTION OF DRAWINGS

Figure 1:
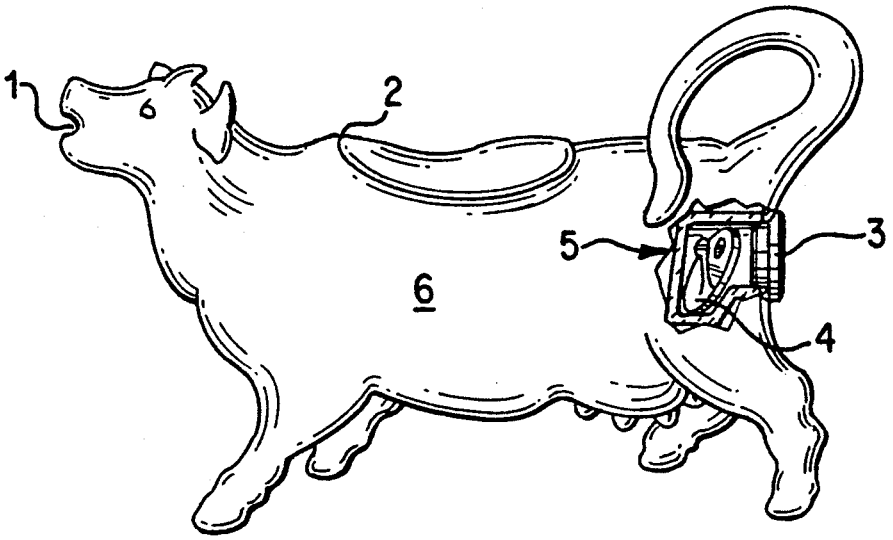
FIG. 1—is a front view of the pitcher.
Figure 4:
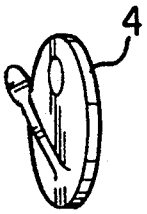
FIG. 4—is the electronic sound device in "OFF" position.
Figure 5:
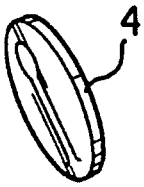
FIG. 5—is the electronic sound device in "ON" position.
Figure 6:
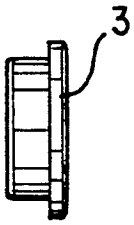
FIG. 6—is a side view of the plastic plug for chamber 4, FIG. 1.
Figure 7:
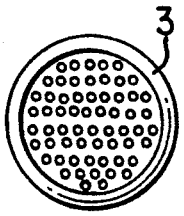
FIG. 7—is a full view of the plastic plug, with perforations for better sound.
Figure 2:
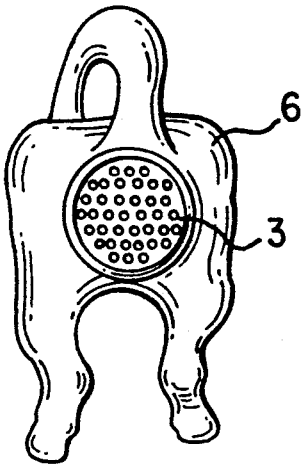
FIG. 2—is a rear view of the pitcher.

In the drawings: FIG. 1, is a profile of a porcelain cow 6 embodying this invention and FIG. 2, is the rear end 3 of the pitcher that will contain the electronic device. FIG. 4, shows the "mooing" sound device in the "OFF" position which is a gravity activated electronic switch and FIG. 5 depicts it in the "ON" position. The disc-like antenna (in FIG. 4) of the "moo" sound device is a very flexible metallic membrane that is attached to the lower part of the chip. When the free-standing upper part of the antenna is pressed against the chip (see FIG. 5). it creates electrical discharge and activates the "mooing" sound the oval opening 2 at the top of the cow (FIG. I) is for the purpose of filling the hollow body of the cow with milk or other liquids.

Figure 3:
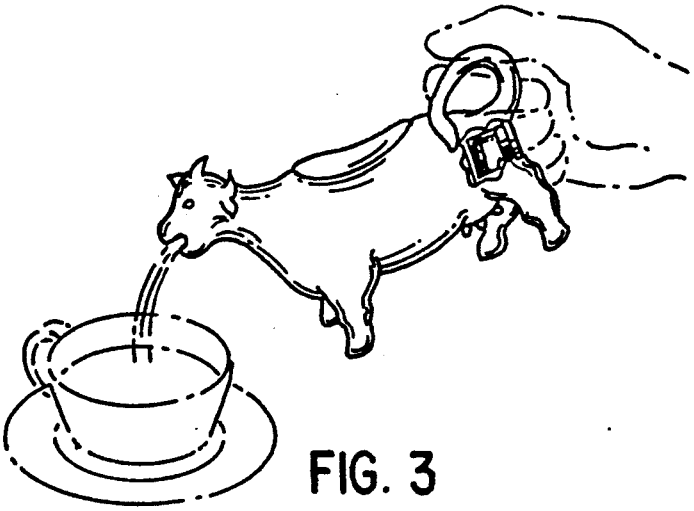
FIG. 3—is the pitcher in a tilted position.

FIG. 3, is a side view of the cow at a tilted position. In order to get the electronic chip to "moo", it must be inserted into the chamber located at the rear end of the cow (see FIG. 1, #5).

When the cow is tilted to pour the milk/cream from an outlet 1 located at the mouth of the cow, the chip moves from position 4 to position 5 (see FIG. 1) therby the antenna of the chip makes contact with the upper part of the chip by pressing against the wall of chamber 5, and the "moo" sound is activated.

It is not desired to limit the construction to this particular outline only. Other animal forms can be developed that would employ the same principles and come within the scope of the appended claims as well as other forms of electronic devices (they're) available in different forms and shapes).

Having thus described the invention, what is claimed is:

1. A pitcher, in the form of an animal, including a hollow body and an outlet for pouring liquid, the body defining a liquid reservoir with an oval opening at the top of the animal and wherein the body includes a hollow chamber where a gravity activated electronic switch is manually placed said electronic switch moving relative to the hollow chamber for the purpose of producing the sound of an animal when the pitcher is tilted to pour the liquid.

2. The pitcher as defined in claim 1 wherein the hollow chamber is located at the rear of the animal.

3. The pitcher as defined in claim 1 with the outlet being located at the mouth of the animal for the purpose of pouring the liquid.

4. The pitcher as defined in claim 1 in the form of an animal made out of porcelain or plastic.

* * * * *